US011005214B2

(12) United States Patent
Edwards

(10) Patent No.: US 11,005,214 B2
(45) Date of Patent: May 11, 2021

(54) LOCKING ELECTRICAL ADAPTOR

(71) Applicant: William Edwards, Brackettville, TX (US)

(72) Inventor: William Edwards, Brackettville, TX (US)

( * ) Notice: Subject to any disclaimer, the term of this patent is extended or adjusted under 35 U.S.C. 154(b) by 0 days.

(21) Appl. No.: 16/598,330

(22) Filed: Oct. 10, 2019

(65) Prior Publication Data

US 2020/0153160 A1 May 14, 2020

Related U.S. Application Data

(60) Provisional application No. 62/758,087, filed on Nov. 9, 2018.

(51) Int. Cl.

| | |
|---|---|
| ***H01R 13/627*** | (2006.01) |
| ***H01R 13/635*** | (2006.01) |
| ***H01R 13/20*** | (2006.01) |
| ***H01R 24/30*** | (2011.01) |
| *H01R 103/00* | (2006.01) |

(52) U.S. Cl.

CPC ..... *H01R 13/6272* (2013.01); *H01R 13/20* (2013.01); *H01R 13/635* (2013.01); *H01R 24/30* (2013.01); *H01R 2103/00* (2013.01)

(58) Field of Classification Search

CPC .. H01R 13/6272; H01R 13/20; H01R 13/635; H01R 24/30

USPC ..... 439/108, 346, 263

See application file for complete search history.

(56) References Cited

U.S. PATENT DOCUMENTS

| | | | | | |
|---|---|---|---|---|---|
| 3,858,956 | A * | 1/1975 | Garrett | H01R 13/652 | 439/106 |
| 3,890,025 | A * | 6/1975 | Gray | H01R 13/652 | 439/102 |
| 4,078,848 | A * | 3/1978 | Blairsdale | H01R 13/652 | 439/103 |
| 4,111,509 | A * | 9/1978 | Novak | H01R 13/652 | 439/102 |
| 4,531,800 | A | 7/1985 | Avener | | |
| 4,544,216 | A * | 10/1985 | Imhoff | H01R 13/639 | 439/106 |
| 5,082,450 | A * | 1/1992 | Warren, Sr. | H01R 13/6395 | 439/102 |
| 5,194,013 | A * | 3/1993 | Propp | H01R 13/6392 | 439/102 |
| 5,316,493 | A * | 5/1994 | Sowers | H01R 13/443 | 439/148 |

(Continued)

*Primary Examiner* — Peter G Leigh

(74) *Attorney, Agent, or Firm* — Boudwin Intellectual Property; Daniel Boudwin

(57) ABSTRACT

A locking electrical adaptor. The adaptor includes a housing with a pair of conductive prongs for carrying an electrical current, and a grounding prong for grounding an electrical connection of the pair of conductive prongs. The grounding prong is comprised of a flexible conductive material, and includes a lip on a portion thereof, such that upon insertion of the adaptor into an electrical outlet, the lip snaps into place behind a ridge of the electrical outlet to secure the adaptor thereto and lock it in place. The adaptor may be unlocked by depressing a button disposed on the housing, which bends the grounding prong and displaces the lip. After the adaptor is unlocked, the adaptor may be removed from the electrical outlet.

8 Claims, 6 Drawing Sheets

(56) References Cited

U.S. PATENT DOCUMENTS

| | | | | |
|---|---|---|---|---|
| 5,480,318 | A * | 1/1996 | Garrison | H01R 13/20 439/102 |
| 5,622,509 | A * | 4/1997 | Smythe | H01R 13/652 439/103 |
| 5,641,292 | A * | 6/1997 | Fann | H01R 13/652 439/103 |
| 6,171,129 | B1 * | 1/2001 | Phillips | H01R 13/193 439/263 |
| 6,419,504 | B1 * | 7/2002 | Nelson | H01R 13/652 439/103 |
| 6,699,058 | B1 | 3/2004 | Estrela et al. | |
| 7,014,493 | B1 | 3/2006 | Battard | |
| 7,172,451 | B1 | 2/2007 | Ratzlaff | |
| 7,347,703 | B2 * | 3/2008 | Gallardo | H01R 13/6397 439/133 |
| 7,798,838 | B2 * | 9/2010 | Grieff | H01R 31/06 439/346 |
| 8,133,060 | B2 * | 3/2012 | Wadsworth | H01R 35/02 439/21 |
| 9,531,126 | B2 | 12/2016 | Krietzman et al. | |
| 2004/0147157 | A1 * | 7/2004 | Burton | H01R 9/2475 439/346 |
| 2006/0046541 | A1 * | 3/2006 | Bhutani | H01R 35/04 439/131 |
| 2009/0061667 | A1 * | 3/2009 | Grieff | H01R 31/06 439/151 |

* cited by examiner

LOCKING ELECTRICAL ADAPTOR

CROSS REFERENCE TO RELATED APPLICATIONS

This application claims priority under 35 U.S.C. § 119(e) to U.S. Provisional Application No. 62/758,087 filed on Nov. 9, 2018. The above identified patent application is incorporated by reference herein in its entirety to provide continuity of disclosure.

BACKGROUND OF THE INVENTION

The present invention relates to a locking electrical adaptor for securing an electrical connection between the adaptor and an electrical outlet.

An electrical adaptor is inserted into an electrical outlet to complete a circuit such that a current of the circuit is transmitted through a utility connected to the adaptor, for use of the utility. Many such utilities may require movement to operate the utility, such as rolling a vacuum cleaner, operating a floor buffer, using a power drill at various positions within a space, and the like. These movements can contribute to an increased risk of the adaptor becoming disengaged from the outlet, which opens the circuit and disrupts usage of the utility. These interruptions can be frustrating and labor-intensive, and can lead to mistakes made when using the utility. In addition, some outlets may be positioned at an odd angle, such as on a ceiling or other structure, such that use of the outlet may be difficult or impossible in view of the adaptor persistently falling out of the outlet or otherwise becoming loose such that the circuit is opened.

Therefore, there is a need for an electrical adaptor that removably locks in place within an electrical outlet, such that the adaptor does not fall out of the outlet during use of the adaptor. The present invention addresses this unmet need.

Devices have been disclosed in the art that relate to electrical adaptors. These include devices that have been patented and published in patent application publications. These devices are often difficult to use, and unsatisfactory in the sense that they do not effectively reduce the probability of the adaptor opening a circuit or falling out of the outlet. In view of the devices disclosed in the art, it is submitted that there is a need in the art for an improvement to existing electrical adaptors. In view of the present disclosure, it is submitted that the present invention substantially diverges in structural and functional elements from devices in the art, and substantially fulfills an unmet need in the art.

SUMMARY OF THE INVENTION

In view of the disadvantages inherent in the known types of electrical adaptors in the art, the present invention provides a new and improved locking electrical adaptor, wherein the same can be utilized for removably locking the adaptor within an electrical outlet.

It is therefore an object of the present invention to provide a locking electrical adaptor for maintaining an electrical connection between the locking electrical adaptor and an electrical outlet, such as a wall outlet, for use of an electrical utility. The present invention provides an effective means to secure an electrical adaptor within a wall outlet, such that various forces, such as gravity, pulling, and lateral forces, do not disrupt the connection and circuit.

In one aspect, the present invention provides a locking electrical adaptor, comprising a housing with a button thereon. A pair of conductive prongs extend forward from a forward surface of the housing, and the prongs of the pair of conductive prongs are configured to carry an electrical current in a circuit. A biased grounding prong that grounds the circuit is included, such that the biased grounding prong comprises a lip thereon. The adaptor may be inserted into an electrical outlet, such that a bias of the biased grounding prong engages the lip with a ridge of the electrical outlet to lock the adaptor in the electrical outlet. After the adaptor is locked in the electrical outlet, the button is depressed to overcome the bias of the biased grounding prong and displace the lip, which disengages the ridge to unlock the adaptor for removal from the electrical outlet. The locking electrical adaptor utilizes the biased grounding prong, with the lip thereon, as a locking mechanism to secure the adaptor within the electrical outlet. In this manner, the locking mechanism is integral with the structure of the locking electrical adaptor, and in certain embodiments, may require little or no additional structure or function.

In some embodiments, the biased grounding prong is monolithic with the lip. In such embodiments, the biased grounding prong is a single piece of material and is structurally continuous. Such embodiments may be advantageous for simplification of manufacture and use of the locking electrical adaptor, and additionally, may require no additional or separate structure affixed to the biased grounding prong for use of the locking mechanism.

In some embodiments, the biased grounding prong is comprised of an elongated strip of a flexible conductive material. In such embodiments, the elongated strip may be comprised of a flexible metal, such that the biased grounding prong can both ground the circuit and flexibly engage the electrical outlet. In addition, the flexibility of the conductive material may be the source of the bias of the biased grounding prong. In this manner, additional structures may not be needed for the bias, such as springs and the like. In addition, in such embodiments, the flexibility of the biased grounding prong may be limited to flexible movement in two dimensions for use of the bias to both secure the lip of the grounding prong within the electrical outlet and push on the button to bias the button in an extended configuration, as described elsewhere herein.

In some embodiments, the elongated strip includes an upper portion connected to a lower portion by a U-shaped forward end of the elongated strip. In such embodiments, the elongated strip includes a lateral gap on a medial portion thereof, such that the upper portion lies above or adjacent to the lower portion, and the lateral gap is between the upper portion and the lower portion. The lateral gap provides a space for a flexible movement of the elongated strip, as may occur during insertion into and removal from the electrical outlet.

In some embodiments, the lip is disposed on the lower portion of the elongated strip. In such embodiments, the flexible movement of the elongated strip occurs by a flexible movement of the lower portion for displacement of the lip, as occurs during insertion and locking, as well as unlocking and removal, as described elsewhere herein.

In some embodiments, the button comprises an interior portion within the housing and an exterior portion that extends out of the housing, such that the interior portion engages the lower portion of the elongated strip. In such embodiments, a bias of the lower portion of the elongated strip presses downward on the interior portion of the button to cause the exterior portion to be fully extruded from the housing. When the exterior portion is depressed, the bias of the lower portion is overcome, and the exterior portion becomes minimally extruded from the housing as the lip is displaced, e.g., to unlock the adaptor for removal from the outlet.

In some embodiments, the lip comprises a rearward vertical wall and a forward sloped wall. Such a structure may be advantageous for effectively locking the adaptor within the outlet, and for effectively unlocking the adaptor from the outlet for removal. The rearward vertical wall engages the ridge of the outlet in the locked configuration and does not engage the ridge of the outlet in the unlocked configuration.

In some embodiments, the forward sloped wall slidably engages the ridge to overcome the bias of the biased grounding prong during insertion, such that after insertion, the bias of the biased grounding prong moves the lip and the rearward vertical wall engages the ridge to lock the adaptor in the electrical outlet. In such embodiments, after the lip passes the ridge, the lip may click or snap into place behind the ridge within the outlet, such that the rearward vertical wall rests against the ridge to place the adaptor in a locked configuration. In the locked configuration, the biased grounding prong is essentially the same as it is in the unlocked configuration, except that it is locked within the outlet; the biased grounding prong is under little or no structural tension, at a forward end thereof or elsewhere.

In some embodiments, the housing further comprises an electrical cord that extends rearward from a rearward surface of the housing. In such embodiments, the housing may be configured such that any movement of a utility attached thereto during use has a range of motion that corresponds to a range of motion of the electrical cord that extends rearward. In this manner, in such embodiments, the adaptor may be useful for locking within an outlet that is installed upright within a wall, and additionally may be useful or advantageous for use with an outlet that is installed within a ceiling.

In some embodiments, the housing further comprises an electrical cord that extends upward from an upper surface of the housing. In certain of such embodiments, the housing may be configured for use with an outlet that is installed upside down within a wall, such that a grounding prong aperture of the outlet is positioned above a pair of current prong apertures of the outlet. In this manner, the button may be positioned upward for easy visualization before, during, and after use of the button, and a strain on the electrical cord may be minimized because the upper surface of the housing may be positioned downward such that the electrical cord drapes downward with the force of gravity.

Another object of the present invention is to provide a locking electrical adaptor that may be readily manufactured from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
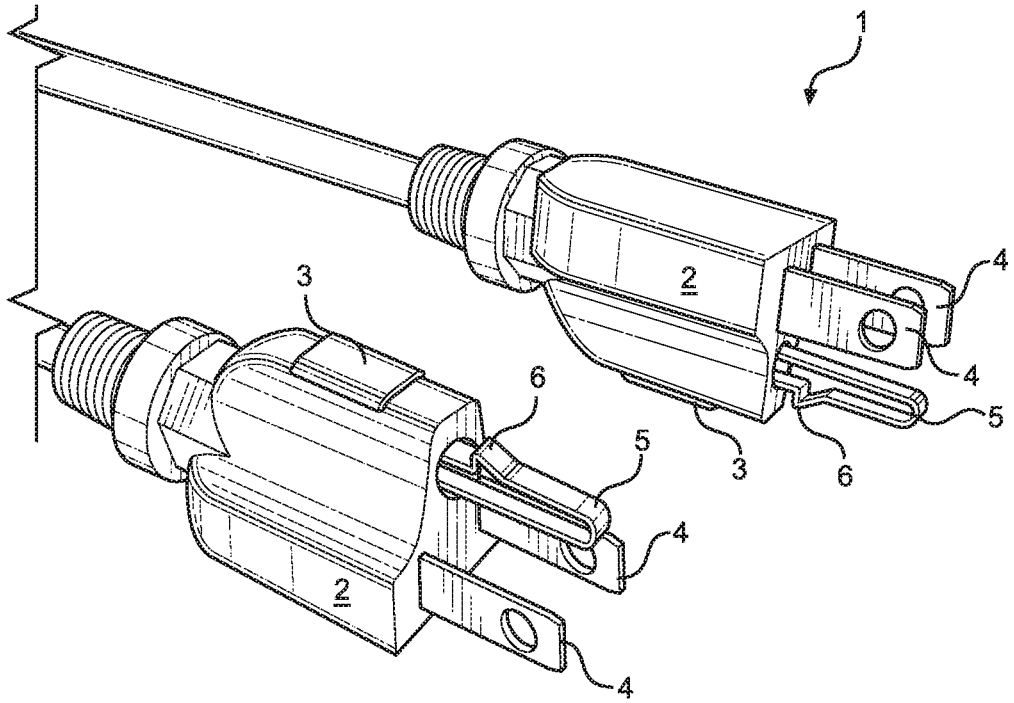
FIG. 1 depicts a perspective view of a first embodiment of a locking electrical adaptor of the present invention.

Reference is made herein to the attached drawings. Like reference numerals are used throughout the drawings to depict like or similar elements of the invention. The figures are intended for representative purposes only and should not be considered limiting in any respect.

Referring now to FIGS. 1, 2, 3A, 3B, 4A, and 4B, there are depicted several views of a first embodiment of a locking electrical adaptor according to the present invention. In the shown embodiment, the locking electrical adaptor 1 includes a housing 2 with an electrical cord that extends rearward from a rearward surface of the housing 2. The rearward-extending electrical cord may be advantageous for maximizing a range of motion of a utility attached thereto during use, and may also be helpful with regular use, e.g., regular locking and unlocking of the adaptor 1 with respect to an electrical outlet 7. In addition, because the electrical cord extends straight out of the rearward surface of the housing 2 and is perpendicular to the electrical outlet 7 when inserted thereto, such embodiments may be beneficial for use with electrical outlets positioned on ceilings or other irregularly angled configurations. In this manner, a weight of the cord may not disfigure or disconnect one or more prongs of the adaptor 1 over time, thereby maximizing the lifespan and safety of the adaptor 1.

FIGS. 5, 6, 7A, 7B, 8A, and 8B depict several views of a second embodiment of the locking electrical adaptor. In the shown embodiment, the locking electrical adaptor 1 includes a housing 2 with an electrical cord that extends upward from an upper surface of the housing 2. In these figures the electrical cord is depicted as extending upward, and the electrical outlet 7 is depicted as installed upright within the wall, for consistent presentation of the present invention. However, it should be understood that some electrical outlets are installed upside down within the wall, such that a grounding prong aperture 9 of the outlet 7 is positioned above a pair of current prong apertures 8 of the outlet 7, as would be understood by a person having ordinary skill in the art. In this manner, such embodiments of the adaptor 1 may be advantageous for use with upside down outlets 7. In addition, in such embodiments, the cord would extend downward, with the force of gravity. In this manner, a stress or strain on the cord may be minimized, particularly if an object such as a piece of furniture is abutted against the adaptor 1 when locked within the outlet 7. The minimal stress or strain maximizes the lifespan and safety of the adaptor 1 in such scenarios and embodiments.

Figure 5:
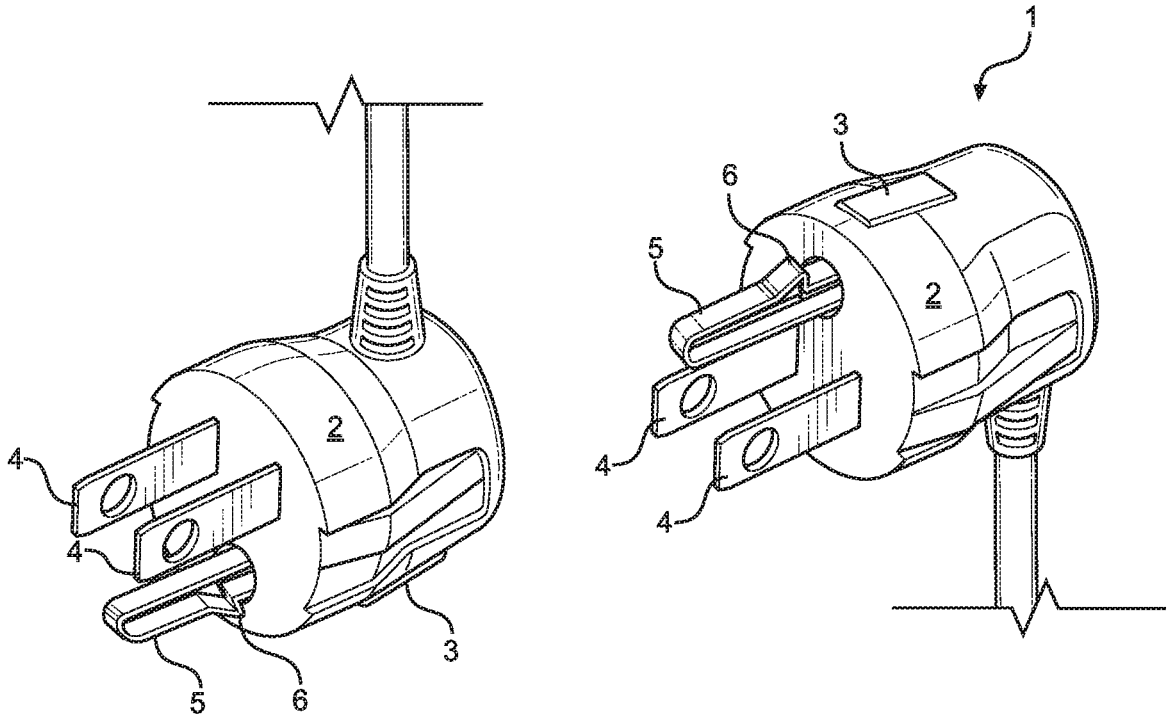
FIG. 5 depicts a perspective view of a second embodiment of the locking electrical adaptor.

Referring now to FIGS. 1 and 5, there are depicted perspective views of the first (FIG. 1) and second (FIG. 5) embodiments of the locking electrical adaptor 1. The locking electrical adaptor 1 includes the housing 2 with the button 3 thereon, and a pair of conductive prongs 4 extend forward from a forward surface of the housing 2 in an arrangement configured for use with new or existing electrical outlets. The prongs of the pair of conductive prongs 4 are conductive and configured to carry an electrical current in a circuit as provided by an electrical outlet. A biased grounding prong 5 extends forward from the forward surface of the housing 2 and includes a lip 6 thereon for locking the adaptor 1 within an electrical outlet.

The bias of the biased grounding prong 5 enables the adaptor to be inserted into the electrical outlet, such that the bias of the grounding prong engages the lip 6 with a ridge of the electrical outlet to lock the adaptor 1 in the electrical outlet. After the adaptor 1 is locked in the electrical outlet, the button 3 is depressed to overcome the bias of the biased grounding prong 5 and displace the lip 6, which disengages the ridge of the electrical outlet to unlock the adaptor 1 for removal from the electrical outlet.

Figure 2:
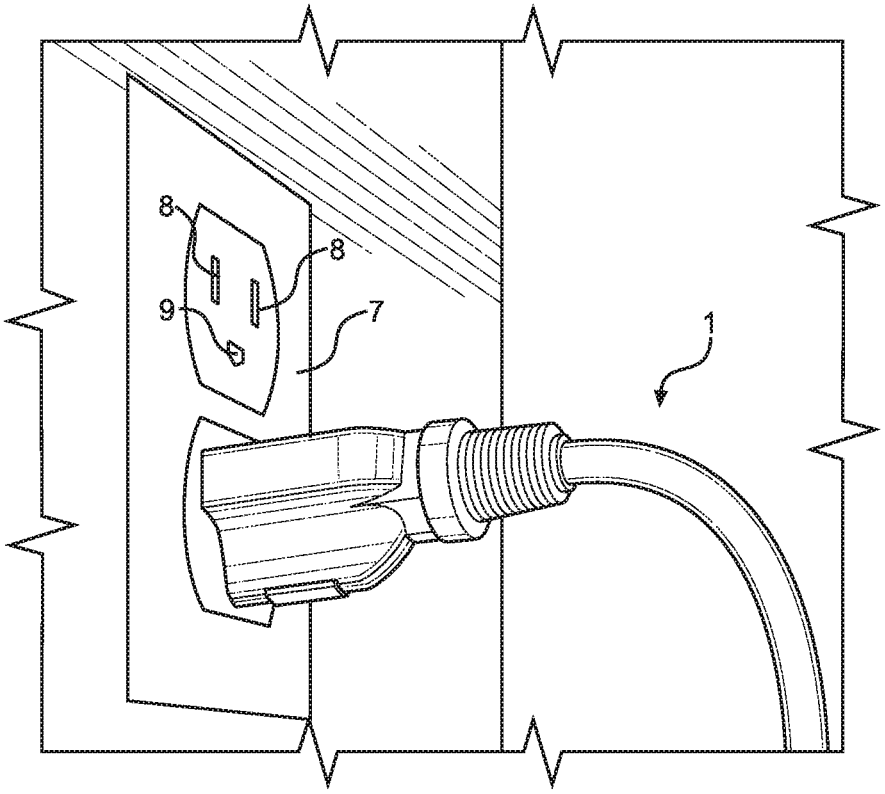
FIG. 2 depicts a perspective view of the first embodiment of the locking electrical adaptor, locked within an electrical outlet of a wall.
Figure 6:
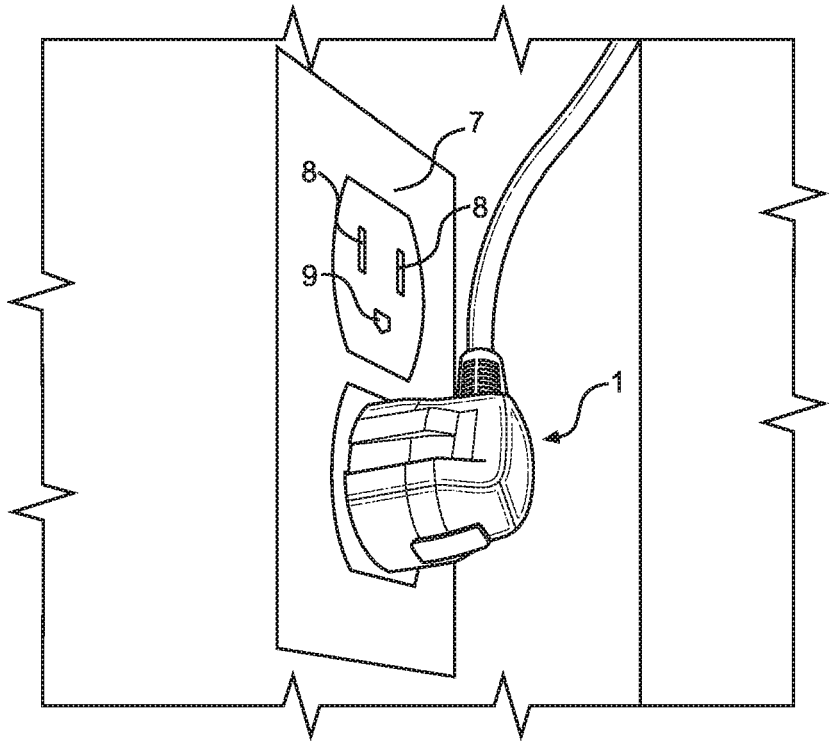
FIG. 6 depicts a perspective view of the second embodiment of the locking electrical adaptor, locked within the electrical outlet of the wall.

Referring now to FIGS. 2 and 6, there are depicted perspective views of the first (FIG. 2) and second (FIG. 6) embodiments of the locking electrical adaptor 1, locked within an electrical outlet of a wall. The locking electrical adaptor 1 is configured for use with the electrical outlet 7, such as a standard electrical outlet 7, which includes the pair of current prong apertures 8 and the grounding prong aperture 9. In the shown embodiment, the electrical outlet 7 is installed to the wall in an upright orientation, however, in some embodiments the electrical outlet 7 is installed to the wall in an upside-down orientation.

Figure 3A:
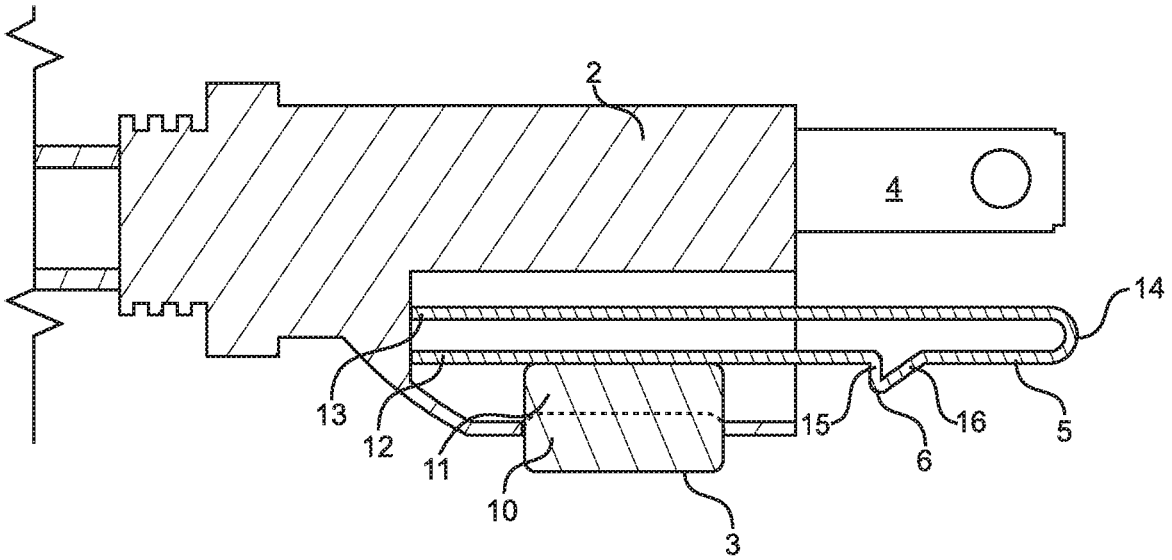
FIG. 3A depicts a cross sectional view of the first embodiment of the locking electrical adaptor, with a biased grounding prong in an unstrained configuration.
Figure 3B:
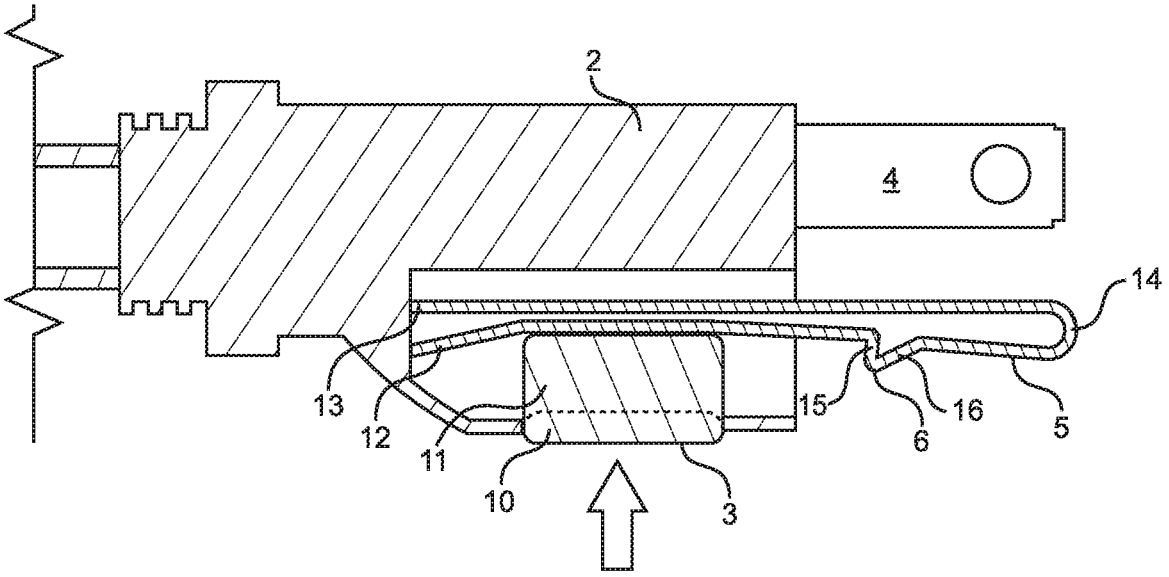
FIG. 3B depicts a cross sectional view of the first embodiment of the locking electrical adaptor, with the biased grounding prong in a strained configuration.
Figure 7A:
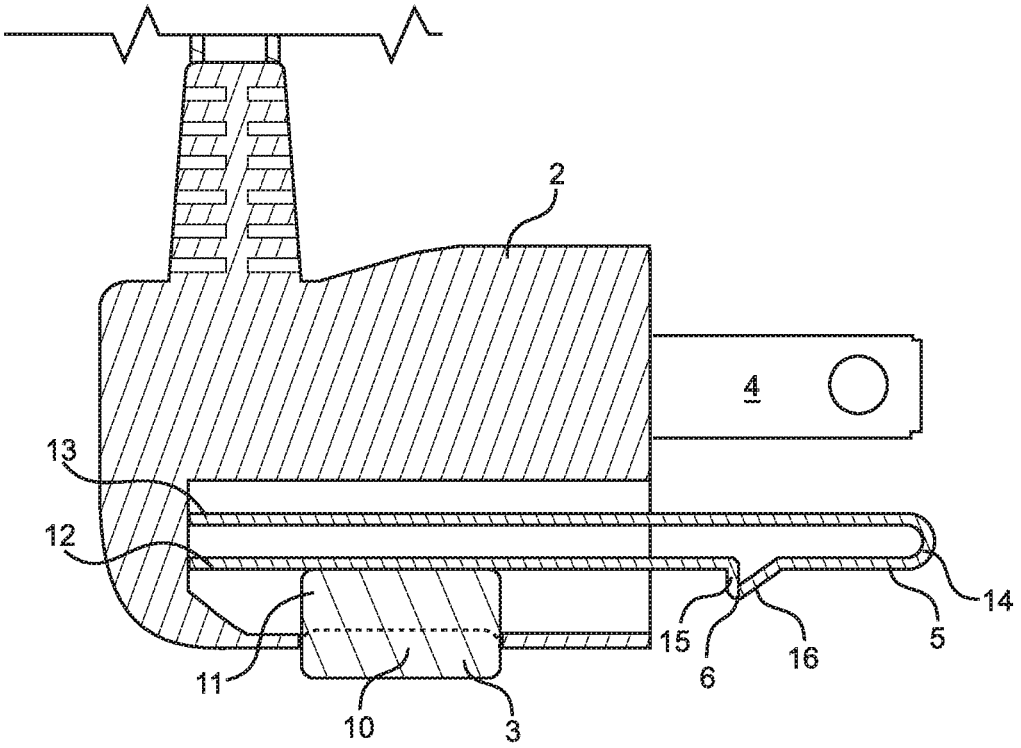
FIG. 7A depicts a cross sectional view of the second embodiment of the locking electrical adaptor, with a biased grounding prong in an unstrained configuration.
Figure 7B:
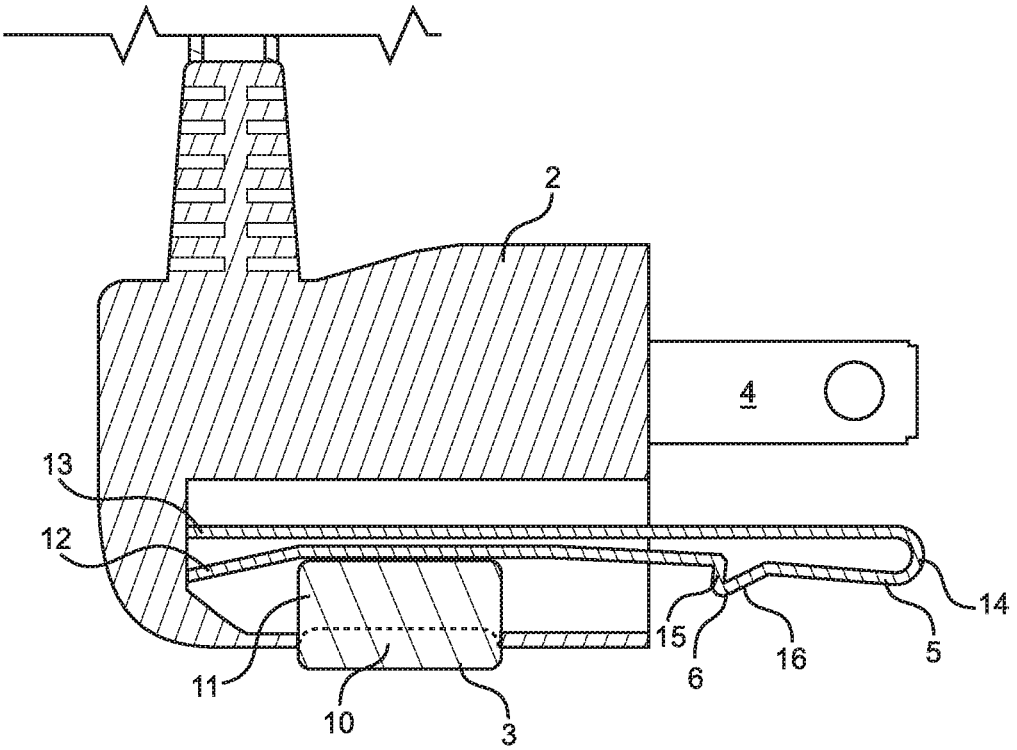
FIG. 7B depicts a cross sectional view of the second embodiment of the locking electrical adaptor, with the biased grounding prong in a strained configuration.

Referring now to FIGS. 3A-3B and 7A-7B, there are depicted cross sectional views of the first (FIGS. 3A-3B) and second (FIGS. 7A-7B) embodiments of the locking electrical adaptor, with the biased grounding prong 5 in an unstrained configuration (FIGS. 3A and 7A) and in a strained configuration (FIGS. 3B and 7B). In the unstrained configuration, the biased grounding prong 5 is unstrained, and appears as it would before and after insertion into and locking within the electrical outlet. The biased grounding prong 5 extends forward from the housing 2 and is positioned below the pair of conductive prongs 4, as shown in FIGS. 1 and 5.

In the shown embodiments, the biased grounding prong 5 is comprised of an elongated strip of a flexible conductive material, such as a metal, and in this manner is capable of both bending during use and grounding the circuit. The elongated strip includes an upper portion 13 connected to a lower portion 12 by a U-shaped forward end 14 of the elongated strip, thereby forming a lateral gap on a medial portion thereof. The lateral gap provides a space for a flexible movement of the elongated strip, as depicted in FIGS. 3B and 7B.

In addition, in the shown embodiments, the lip 6 is disposed on the lower portion 12 of the elongated strip, and the flexible movement of the elongated strip occurs by a flexible movement of the lower portion 12 for displacement of the lip 6, e.g., as may occur during insertion and locking, as well as unlocking and removal, as depicted in FIGS. 3B and 7B. In the shown embodiments, the lower portion 12 is displaced toward the upper portion 13, and extends into the medial gap. The button 3 includes an interior portion 11 disposed within the housing 2 and an exterior portion 10 that extends out of the housing 2. The interior portion 11 engages the lower portion 12 of the elongated strip, and a bias of the lower portion 12 presses downward on the interior portion 11 of the button 3 to cause the exterior portion 10 to be fully extruded from the housing. When the exterior portion 10 is depressed, as depicted in FIGS. 3B and 7B, the bias of the lower portion 12 is overcome and the exterior portion 10 becomes minimally extruded from the housing 2 as the lip 6 is displaced.

Further, in the shown embodiments, the biased grounding prong 5 is monolithic with the lip 6, and in this manner, the biased grounding prong is structurally continuous and may require minimal complexity for manufacture. In addition, the lip 6 comprises a rearward vertical wall 15 and a forward sloped wall 16. In this manner, the lip 6 may function as a hook, such that the adaptor may be effectively locked into, and unlocked from, the electrical outlet during use of the adaptor. In the locked configuration, the rearward vertical wall 15 engages the ridge of the outlet, and in the unlocked configuration the rearward vertical wall 15 does not engage the ridge of the outlet, as described elsewhere herein.

Figure 4A:
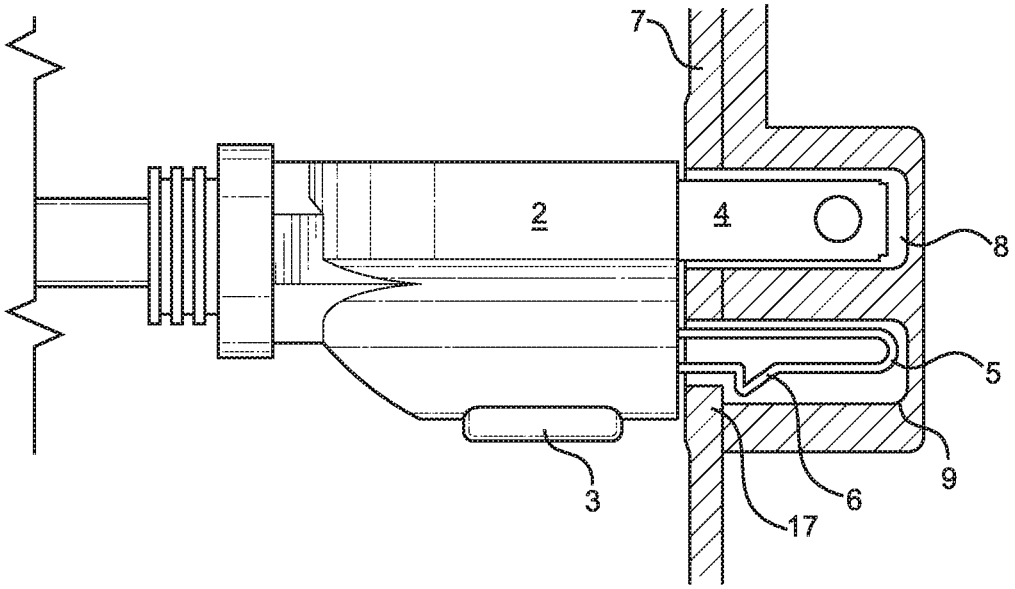
FIG. 4A depicts a side cutout view of the first embodiment of the locking electrical adaptor inserted within the electrical outlet, in a locked configuration.
Figure 4B:
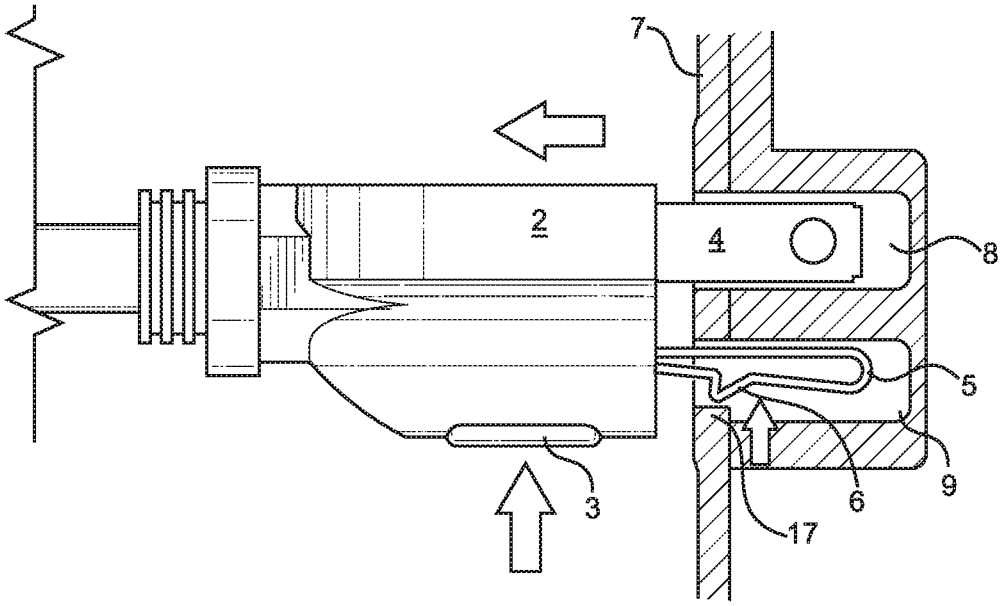
FIG. 4B depicts a side cutout view of the first embodiment of the locking electrical adaptor inserted within the electrical outlet, in an unlocked configuration.
Figure 8A:
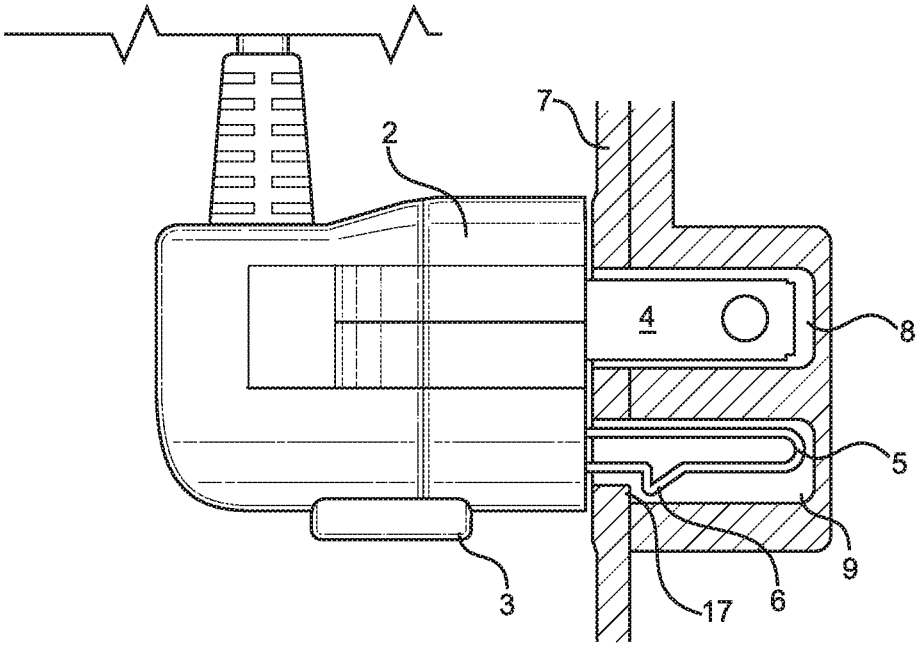
FIG. 8A depicts a side cutout view of the second embodiment of the locking electrical adaptor inserted within the electrical outlet, in a locked configuration.
Figure 8B:
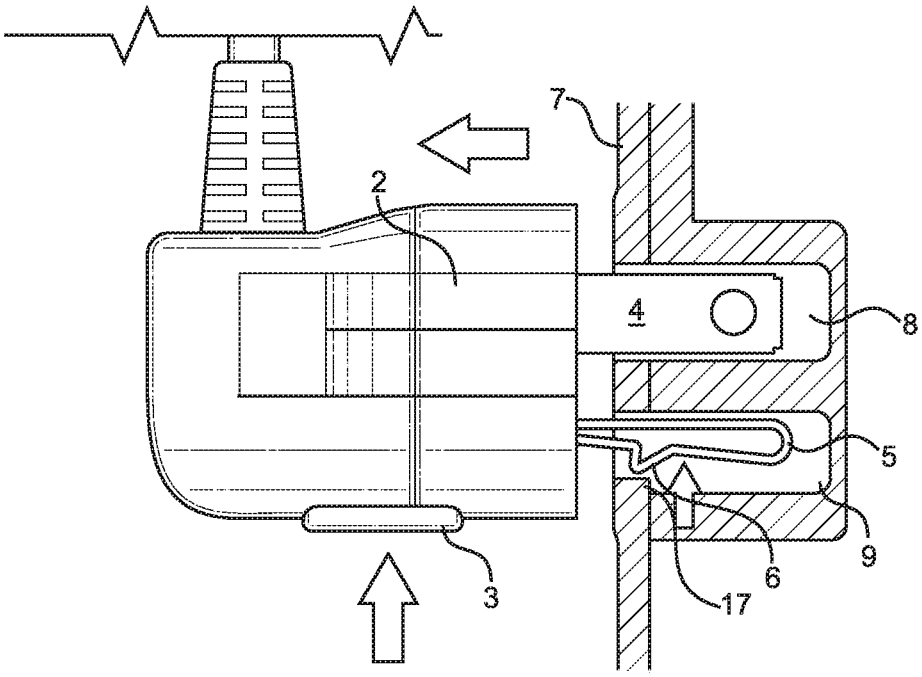
FIG. 8B depicts a side cutout view of the second embodiment of the locking electrical adaptor inserted within the electrical outlet, in an unlocked configuration.

Referring now to FIGS. 4A-4B and 8A-8B, there are depicted side cutout views of the first (FIGS. 4A-4B) and second (FIGS. 8A-8B) embodiments of the locking electrical adaptor inserted within the electrical outlet, in a locked configuration (FIGS. 4A and 8A) and in an unlocked configuration (FIGS. 4B and 8B). In the locked configuration, the housing 2 of the adaptor is flush or nearly flush with the electrical outlet 7, and the pair of conductive prongs 4 and the biased grounding prong 5 are fully inserted within the pair of current prong apertures 8 and the grounding prong aperture 9, respectively. In this configuration, as depicted in FIGS. 4A and 8A, the rearward vertical wall of the lip 6 of the biased grounding prong 5 is adjacent to the ridge 17 of the electrical outlet 7. The ridge 17 is comprised of a structure that juts upward from a lower outer portion of the grounding prong aperture 9, in a direction toward the pair of current prong apertures 8. The ridge 17 may be found in pre-existing or new electrical outlets 7; in the shown embodiment, the ridge 17 is continuous with other structure of the electrical outlet 7. During use of a utility operably connected to the adaptor, the pair of conductive prongs 4 remain within the pair of current prong apertures 8, and the biased grounding prong 5 remains within the grounding prong aperture 9 to maintain the mechanical connection and the circuit for continuous use of the utility. In the unlocked configuration, as depicted in FIGS. 4B and 8B, the button 3 is depressed and the bias of the biased grounding prong is overcome to displace the lip 6, such that the rearward vertical wall of the lip 6 does not abut or engage the ridge 17. In this configuration, the adaptor is ready to be removed from the outlet 7.

In the shown embodiment, the forward sloped wall of the lip 6 slidably engages the ridge 17 to overcome the bias of the biased grounding prong 5 during insertion, and after insertion, the bias of the biased grounding prong 5 moves the lip 6 downward. In this manner, the rearward vertical wall engages the ridge 17 to lock the adaptor in the electrical outlet 7. After the lip 6 passes the ridge 17 during insertion, the lip 6 may click or snap into place behind the ridge 17 within the outlet 7, such that the rearward vertical wall of the lip 6 rests against or near the ridge 17 to place the adaptor in the locked configuration.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. A locking electrical adaptor, comprising:

a housing, comprising a button thereon;

a pair of conductive prongs that extend forward from a forward surface of the housing, wherein the prongs of the pair of conductive prongs are configured to carry an electrical current in a circuit;

a biased grounding prong that grounds the circuit, wherein the biased grounding prong comprises a lip thereon;

wherein the lip comprises a rearward vertical wall and a forward sloped wall;

wherein the forward sloped wall slidably engages the ridge to overcome a bias of the biased grounding prong during insertion;

wherein after insertion the bias of the biased grounding prong moves the lip such that the rearward vertical wall engages the ridge to lock the adaptor in the electrical outlet;

wherein the adaptor is locked in the electrical outlet, the button is depressed to overcome the bias of the biased grounding prong and displace the lip, which disengages the ridge to unlock the adaptor for removable from the electrical outlet.

2. The locking electrical adaptor of claim 1, wherein the biased grounding prong is monolithic with the lip.

3. The locking electrical adaptor of claim 1, wherein the biased grounding prong is comprised of an elongated strip of a flexible conductive material.

4. The locking electrical adaptor of claim 3, wherein the elongated strip includes an upper portion connected to a lower portion by a U-shaped forward end of the elongated strip.

5. The locking electrical adaptor of claim 4, wherein the lip is disposed on the lower portion.

6. The locking electrical adaptor of claim 4, wherein the button comprises an interior portion within the housing and an exterior portion that extends out of the housing, wherein the interior portion engages the lower portion of the elongated strip.

7. The locking electrical adaptor of claim 1, wherein the housing further comprises an electrical cord that extends rearward from a rearward surface of the housing.

8. The locking electrical adaptor of claim 1, wherein the housing further comprises an electrical cord that extends upward from an upper surface of the housing.

* * * * *